US011798347B2

(12) United States Patent
Russ et al.

(10) Patent No.: US 11,798,347 B2
(45) Date of Patent: Oct. 24, 2023

(54) INPUT FOR MULTIPLE GAMING DEVICE DISPLAYS, AND RELATED DEVICES,STEMS, AND METHODS

(71) Applicant: IGT, Las Vegas, NV (US)

(72) Inventors: Michael Russ, Graz (AT); Sven Aurich, Schwanberg (AT)

(73) Assignee: IGT, Las Vegas, NV (US)

( * ) Notice: Subject to any disclaimer, the term of this patent is extended or adjusted under 35 U.S.C. 154(b) by 45 days.

(21) Appl. No.: 16/678,207

(22) Filed: Nov. 8, 2019

(65) Prior Publication Data

US 2021/0142612 A1 May 13, 2021

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/34* (2013.01)

(58) Field of Classification Search
CPC ... G07F 17/3213; G07F 17/3209; G07F 17/34
See application file for complete search history.

(56) References Cited

U.S. PATENT DOCUMENTS 6,270,412 B1 * 8/2001 Crawford ..... G07F 17/3265 273/143 R
9,269,215 B2 2/2016 Thompson
9,558,610 B2 1/2017 Keilwert
9,633,526 B2 4/2017 Polis
9,754,442 B2 9/2017 Dupuis
9,886,818 B2 2/2018 LeBlanc
9,940,785 B2 4/2018 Washington
2007/0167238 A1 * 7/2007 Gatto ..... G07F 17/32 463/42
2010/0234094 A1 * 9/2010 Gagner ..... G07F 17/32 463/20
2011/0225538 A1 * 9/2011 Oyagi ..... H04N 13/31 715/781
2013/0184064 A1 * 7/2013 Manning ..... G07F 17/3237 463/25
2015/0011302 A1 * 1/2015 Mayeroff ..... G07F 17/3267 463/25
2015/0363996 A1 * 12/2015 Keilwert ..... G07F 17/3209 463/31
2017/0323522 A1 11/2017 Hilbert

* cited by examiner

*Primary Examiner* — Thomas H Henry
(74) *Attorney, Agent, or Firm* — Sage Patent Group

(57) ABSTRACT

Input systems for multiple gaming device displays, and related devices, systems, and methods, include a first display device, a second display device, an input device, a processor circuit, and a memory coupled to the processor circuit. The memory includes machine-readable instructions that, when executed by the processor circuit, cause the processor circuit to receive a first input value from the input device. Based on the first input value, the processor circuit causes the first display device to modify a first graphical interface element being displayed on the first display device to generate a first modified graphical interface element on the first display device, and cause the second display device to display a second graphical interface element based on the first modified graphical interface element.

10 Claims, 11 Drawing Sheets

INPUT FOR MULTIPLE GAMING DEVICE DISPLAYS, AND RELATED DEVICES,STEMS, AND METHODS

BACKGROUND

Embodiments described herein relate to providing input for gaming device displays, and in particular to input for multiple gaming device displays, and related devices, systems, and methods.

Gaming devices, such as electronic gaming machines (EGMs), may provide input devices for facilitating play of a game by a user at the gaming device, and for providing additional interactive functionality at the gaming device. Many gaming devices employ input devices, such as buttons or keypads, that may be used to provide various features and functionality at the gaming device.

BRIEF SUMMARY

According to an embodiment, a system includes a first display device, a second display device, a first input device, a processor circuit, and a memory coupled to the processor circuit. The memory includes machine-readable instructions that, when executed by the processor circuit, cause the processor circuit to receive a first input value from the first input device. The instructions further cause the processor circuit to, based on the first input value, cause the first display device to modify a first graphical interface element being displayed on the first display device to generate a first modified graphical interface element on the first display device. The instructions further cause the processor circuit to, based on the first modified graphical interface element, cause the second display device to display a second graphical interface element.

According to another embodiment, a gaming device includes a first display device, a second display device, and a first gesture input device comprising a gesture input sensor to detect a gesture performed by a user associated with the first display device. The gaming device further includes a processor circuit, and a memory coupled to the processor circuit. The memory includes machine-readable instructions that, when executed by the processor circuit, cause the processor circuit to receive a first gesture input value corresponding to the gesture performed by the user from the first gesture input device. The instructions further cause the processor circuit to, based on the first input value, cause the first display device to modify a first graphical interface element being displayed on the first display device to generate a first modified graphical interface element on the first display device. The instructions further cause the processor circuit to, based on the first modified graphical interface element, cause the second display device to display a second graphical interface element.

According to another embodiment, a method includes receiving, by a processor circuit, a first input value from a first input device of a gaming device. The method further includes, based on the first input value, causing a first display device of the gaming device to modify a first graphical interface element being displayed on the first display device to generate a first modified graphical interface element on the first display device. The method further includes, based on the first modified graphical interface element, causing a second display device of the gaming device to display a second graphical interface element.

DETAILED DESCRIPTION

Figure 1:
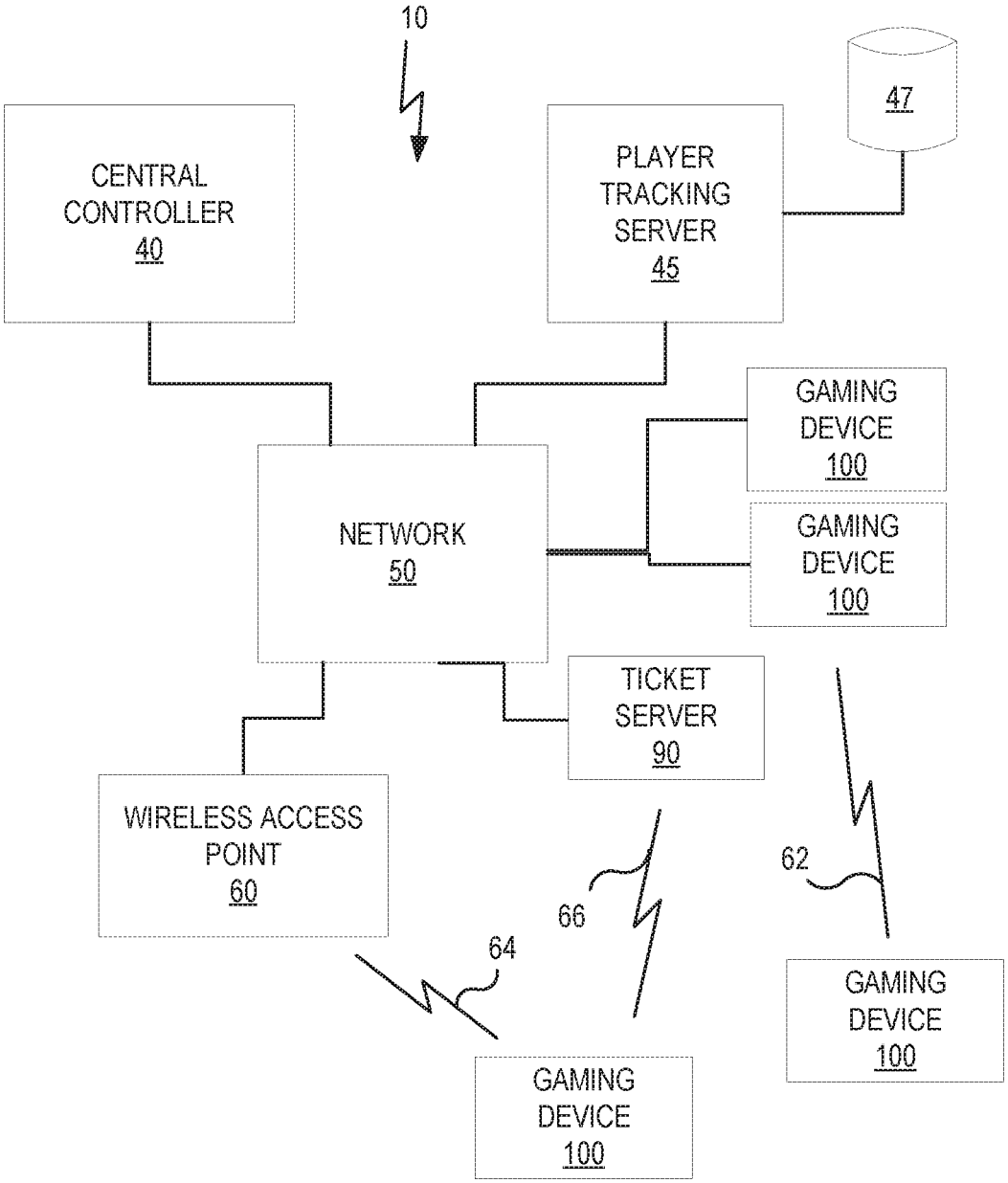
FIG. 1 is a schematic block diagram illustrating a network configuration for a plurality of gaming devices according to some embodiments.

Embodiments described herein relate to providing input for gaming device displays, and in particular to input for multiple gaming device displays, and related devices, systems, and methods. For example, a system may include a first display device, a second display device, an input device. Based on a first input value received from the input device, a processor circuit and memory may cause the first display device to modify a first graphical interface element being displayed on the first display device to generate a first modified graphical interface element on the first display device. Based on the first modified graphical interface element, the processor circuit and memory may then cause the second display device to display a second graphical interface element.

These and other embodiments enable a user at a gaming device to move and interact with virtual objects across multiple displays. For example, a virtual object may be displayed on one or multiple 2D and/or 3D displays of the gaming device, and may be moved between or beyond those displays, for example to another gaming device, or a shared display device. These and other embodiments also provide a unique technical solution to the technical problem of providing novel gaming experiences and gaming device interactions through gesture and other types of gaming device input.

As will be discussed in detail below, many different implementations of these embodiments are contemplated. Object movement examples may include moving one or multiple objects from one display of a gaming device to another display of either the same or another gaming device, based on one or more swipe or other gestures. For example, an object may be displayed on a 2D or 3D display and moved onto another 2D or 3D display, such as displaying an object on a 3D display (e.g., in mid-air) and moving the object onto a 2D display by transforming the object into a 2D projection of the 3D object. An object may also be displayed on a 2D display and moved onto a 3D display by transforming the 2D projected object into a 3D object. Further interaction, e.g., via gesture, touch, etc., may occur after moving the object onto the second display.

In some embodiments, a user may attempt to accurately place an object at an exact position on a second display based on interactions with the object on the first display. For example, a user may interact with an object with one hand on a first display, and interact with the same or different object with another hand on a second display. In some examples, the user may alternatively, or additionally, interact with one or more objects with both hands, and/or with other body parts or physical elements (e.g., kicking a ball, swinging a physical bat to hit a virtual ball, etc.). In another example, a 2D projection of a 3D object may be displayed on a 2D display at the same time that the 3D object is shown in 3D on a 3D display, such as by displaying a 2D projection of a 3D object on a 2D button panel display.

In some embodiments, an object may be selectively moved onto one of a plurality of available displays, e.g., via corresponding gestures. Different actions may be triggered by moving the object onto different displays. In other embodiments, multiple users may be associated with different displays, with some or all of the users interacting with common objects across the multiple displays and/or shared displays. In some embodiments, users could compete against each other (e.g., compete for an award) and/or cooperate with each other (e.g., collect objects together to trigger a shared bonus). For example, a first user may move an object to a second user's display, enabling the second user to interact with the object competitively and/or cooperatively.

In some embodiments, a bonus symbol may be received on a first display, and moved to a second display to be placed on one of multiple available positions to trigger a bonus feature. For example, a bonus game could include moving an object into a correspondingly shaped hole, or a jigsaw puzzle game may include users moving and/or rotating puzzle pieces into their correct positions on a shared display either cooperatively (e.g., to solve the puzzle within a time limit) or competitively (e.g., to compete to place the most pieces). Shared screen(s) may also act as a repository for multiple users, with users placing and/or taking objects to or from the shared screen(s). For example, a user may collect bonus symbols on a touch panel display and move the symbols away from the touch panel display via gesture and place the symbols at specific positions on a second display, such as on reels of a slot game. In another example, an object from a first gaming device in a bank of devices may be moved to a second device in the bank while a user continues playing at the first device.

Another example may include moving an object from a lower screen to a higher screen while avoids obstacles, with a score based on how high the object can be moved. Other examples may include drawing objects across multiple screens, with a score based on drawing accuracy. In another example, a torch may might light up a room, ranging across multiple displays, with the torch being moved via hand gesture, to find hidden objects (such as hidden gems, for example) on the different screens, or a reflector may be moved via hand gesture to reflect a laser beam onto other displays to hit other objects. In other examples, coins may be scattered across multiple displays, with a user moving a hand over multiple screens to collect as many coins as possible. In another example, entire reels may be moved from one screen to another, with different reel games on different screens, or with reels being selectively stored and moved back to a reel game matrix when the reel would cause a favorable game result.

Before discussing these and other embodiments in greater detail, reference is made to FIG. 1, which illustrates a gaming system 10 including a plurality of gaming devices 100. As discussed above, the gaming devices 100 may be one type of a variety of different types of gaming devices, such as electronic gaming machines (EGMs), mobile devices, or other devices, for example. The gaming system 10 may be located, for example, on the premises of a gaming establishment, such as a casino. The gaming devices 100, which are typically situated on a casino floor, may be in communication with each other and/or at least one central controller 40 through a data communication network 50 that may include a remote communication link. The data communication network 50 may be a private data communication network that is operated, for example, by the gaming facility that operates the gaming devices 100. Communications over the data communication network 50 may be encrypted for security. The central controller 40 may be any suitable server or computing device which includes at least one processing circuit and at least one memory or storage device. Each gaming device 100 may include a processing circuit that transmits and receives events, messages, commands or any other suitable data or signal between the gaming device 100 and the central controller 40. The gaming device processing circuit is operable to execute such communicated events, messages or commands in conjunction with the operation of the gaming device 100. Moreover, the processing circuit of the central controller 40 is configured to transmit and receive events, messages, commands or any other suitable data or signal between the central controller 40 and each of the individual gaming devices 100. In some embodiments, one or more of the functions of the central controller 40 may be performed by one or more gaming device processing circuits. Moreover, in some embodiments, one or more of the functions of one or more gaming device processing circuits as disclosed herein may be performed by the central controller 40.

A wireless access point 60 provides wireless access to the data communication network 50. The wireless access point 60 may be connected to the data communication network 50 as illustrated in FIG. 1, and/or may be connected directly to the central controller 40 or another server connected to the data communication network 50.

A player tracking server 45 may also be connected through the data communication network 50. The player tracking server 45 may manage a player tracking account that tracks the user's gameplay and spending and/or other user preferences and customizations, manages loyalty awards for the user, manages funds deposited or advanced on behalf of the user, and other functions. User information managed by the player tracking server 45 may be stored in a player information database 47.

As further illustrated in FIG. 1, the gaming system 10 may include a ticket server 90 that is configured to print and/or dispense wagering tickets. The ticket server 90 may be in communication with the central controller 40 through the data communication network 50. Each ticket server 90 may include a processing circuit that transmits and receives events, messages, commands or any other suitable data or signal between the ticket server 90 and the central controller 40. The ticket server 90 processing circuit may be operable to execute such communicated events, messages or commands in conjunction with the operation of the ticket server 90. Moreover, in some embodiments, one or more of the functions of one or more ticket server 90 processing circuits as disclosed herein may be performed by the central controller 40.

The gaming devices 100 communicate with one or more elements of the gaming system 10 to coordinate providing wagering games and other functionality. For example, in some embodiments, the gaming device 100 may communicate directly with the ticket server 90 over a wireless interface 62, which may be a WiFi link (i.e., using the IEEE 802.11x standard), a Bluetooth link, a near field communications (NFC) link, etc. In other embodiments, the gaming device 100 may communicate with the data communication network 50 (and devices connected thereto, including other gaming devices 100) over a wireless interface 64 with the wireless access point 60. The wireless interface 64 may include a WiFi link, a Bluetooth link, an NFC link, etc. In still further embodiments, the gaming devices 100 may communicate simultaneously with both the ticket server 90 over the wireless interface 66 and the wireless access point 60 over the wireless interface 64. Some embodiments provide that gaming devices 100 may communicate with other gaming devices over a wireless interface 64. In these embodiments, wireless interface 62, wireless interface 64 and wireless interface 66 may use different communication protocols and/or different communication resources, such as different frequencies, time slots, spreading codes, etc.

Gaming Devices

Figure 2A:
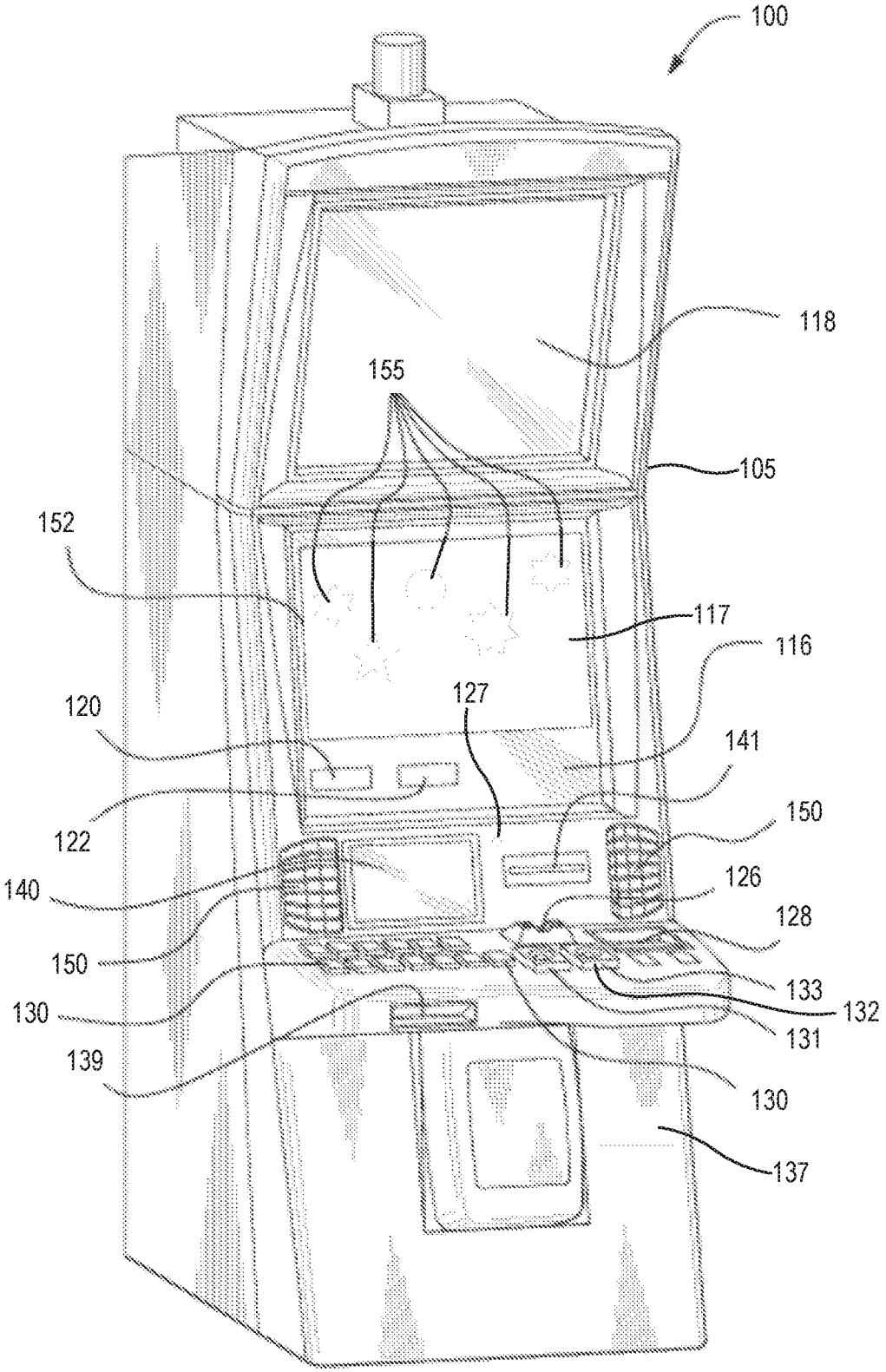
FIG. 2A is a perspective view of a gaming device that can be configured according to some embodiments.
Figure 2B:
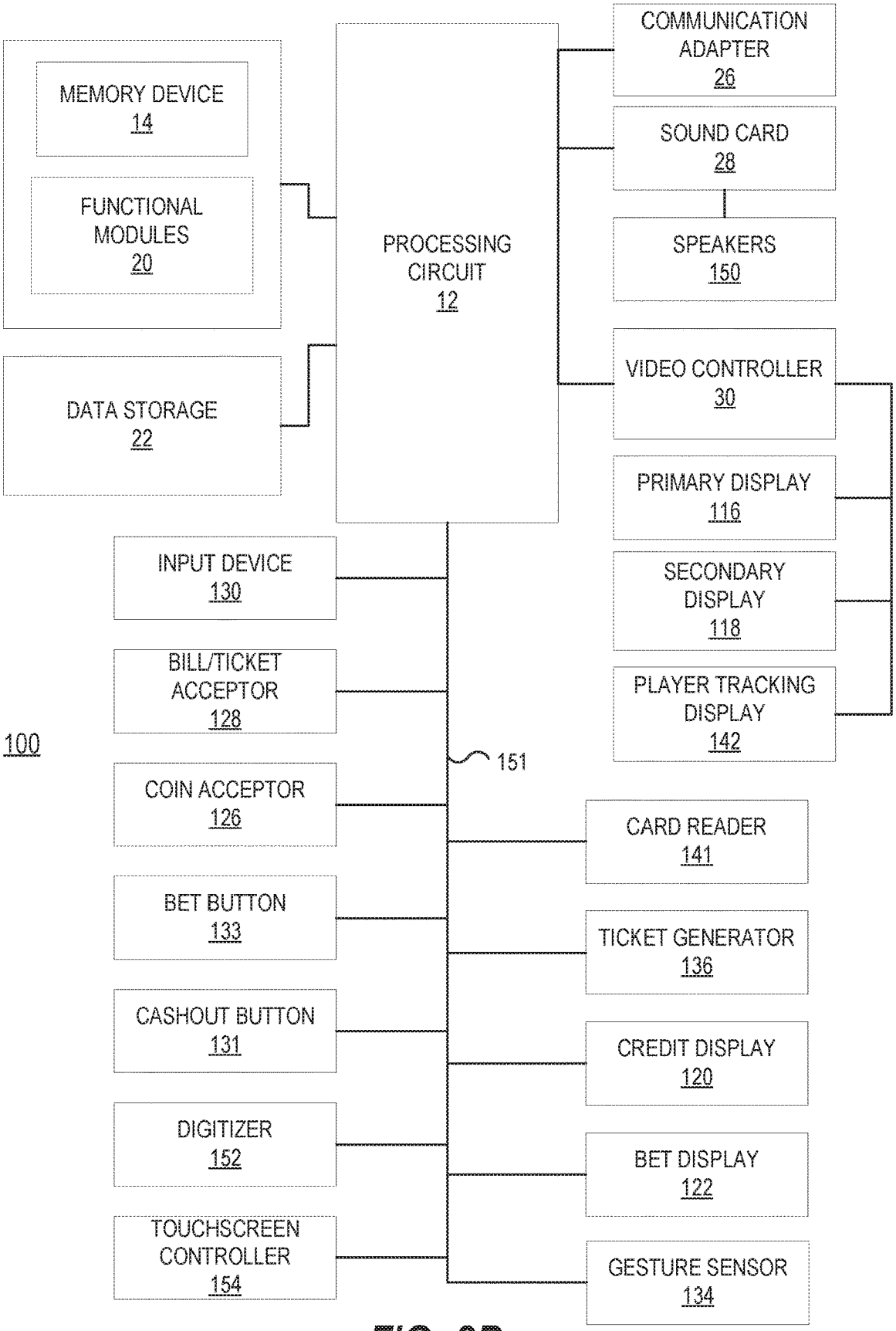
FIG. 2B is a schematic block diagram illustrating an electronic configuration for a gaming device according to some embodiments.
Figure 2C:
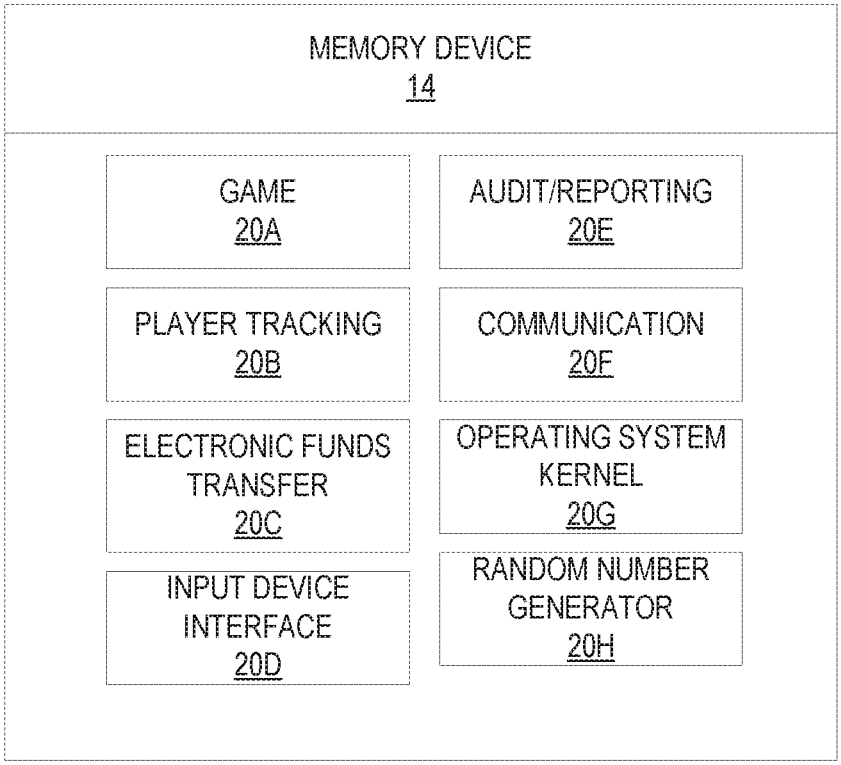
FIG. 2C is a schematic block diagram that illustrates various functional modules of a gaming device according to some embodiments.

Embodiments herein may include different types of gaming devices. One example of a gaming device includes a gaming device 100 that can use gesture and/or touch-based inputs according to various embodiments is illustrated in FIGS. 2A, 2B, and 2C in which FIG. 2A is a perspective view of a gaming device 100 illustrating various physical features of the device, FIG. 2B is a functional block diagram that schematically illustrates an electronic relationship of various elements of the gaming device 100, and FIG. 2C illustrates various functional modules that can be stored in a memory device of the gaming device 100. The embodiments shown in FIGS. 2A to 2C are provided as examples for illustrative purposes only. It will be appreciated that gaming devices may come in many different shapes, sizes, layouts, form factors, and configurations, and with varying numbers and types of input and output devices, and that embodiments of the inventive concepts are not limited to the particular gaming device structures described herein.

Gaming devices 100 typically include a number of standard features, many of which are illustrated in FIGS. 2A and 2B. For example, referring to FIG. 2A, a gaming device 100 may include a support structure, housing 105 (e.g., cabinet) which provides support for a plurality of displays, inputs, outputs, controls and other features that enable a user to interact with the gaming device 100.

The gaming device 100 illustrated in FIG. 2A includes a number of display devices, including a primary display device 116 located in a central portion of the housing 105 and a secondary display device 118 located in an upper portion of the housing 105. A plurality of game components 155 are displayed on a display screen 117 of the primary display device 116. It will be appreciated that one or more of the display devices 116, 118 may be omitted, or that the display devices 116, 118 may be combined into a single display device. The gaming device 100 may further include a player tracking display 142, a credit display 120, and a bet display 122. The credit display 120 displays a player's (or other user's) current number of credits, cash, account balance or the equivalent. The bet display 122 displays a player's amount wagered. Locations of these displays are merely illustrative as any of these displays may be located anywhere on the gaming device 100.

The player tracking display 142 may be used to display a service window that allows the player to interact with, for example, their player loyalty account to obtain features, bonuses, comp s, etc. In other embodiments, additional display screens may be provided beyond those illustrated in FIG. 2A. In some embodiments, one or more of the player tracking display 142, the credit display 120 and the bet display 122 may be displayed in one or more portions of one or more other displays that display other game related visual content. For example, one or more of the player tracking display 142, the credit display 120 and the bet display 122 may be displayed in a picture in a picture on one or more displays.

The gaming device 100 may further include a number of input devices 130 that allow a user to provide various inputs to the gaming device 100, either before, during or after a game has been played. The gaming device may further include a game play initiation button 133 and a cashout button 131. The cashout button 131 is utilized to receive a cash payment or any other suitable form of payment corresponding to a quantity of remaining credits of a credit display.

In some embodiments, one or more input devices of the gaming device 100 are one or more game play activation devices that are each used to initiate a play of a game on the gaming device 100 or a sequence of events associated with the gaming device 100 following appropriate funding of the gaming device 100. The example gaming device 100 illustrated in FIGS. 2A and 2B includes a game play activation device in the form of a game play initiation button 133. It should be appreciated that, in other embodiments, the gaming device 100 begins game play automatically upon appropriate funding rather than upon utilization of the game play activation device.

In some embodiments, one or more input device 130 of the gaming device 100 may include wagering or betting functionality. For example, a maximum wagering or betting function may be provided that, when utilized, causes a maximum wager to be placed. Another such wagering or betting function is a repeat the bet device that, when utilized, causes the previously-placed wager to be placed. A further such wagering or betting function is a bet one function. A bet is placed upon utilization of the bet one function. The bet is increased by one credit each time the bet one device is utilized. Upon the utilization of the bet one function, a quantity of credits shown in a credit display (as described below) decreases by one, and a number of credits shown in a bet display (as described below) increases by one.

In some embodiments, as shown in FIG. 2B, the input device(s) 130 may include and/or interact with additional components, such as gesture sensors 134 for gesture input devices, and/or a touch-sensitive display that includes a digitizer 152 and a touchscreen controller 154 for touch input devices, as disclosed herein. The user may interact with the gaming device 100 by touching virtual buttons on one or more of the display devices 116, 118, 140. Accordingly, any of the above described input devices, such as the input device 130, the game play initiation button 133 and/or the cashout button 131 may be provided as virtual buttons or regions on one or more of the display devices 116, 118, 140.

Referring briefly to FIG. 2B, operation of the primary display device 116, the secondary display device 118 and the player tracking display 142 may be controlled by a video controller 30 that receives video data from a processing circuit 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processing circuit 12. In some embodiments however, the credit display 120 and/or the bet display 122 may be driven by the video controller 30.

Referring again to FIG. 2A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touchscreen with an associated touchscreen controller 154 and digitizer 152. The display devices 116, 118, 140 may be of any suitable size, shape, and/or configuration. The display devices 116, 118, 140 may include flat or curved display surfaces.

The display devices 116, 118, 140 and video controller 30 of the gaming device 100 are generally configured to display one or more game and/or non-game images, symbols, and indicia. In certain embodiments, the display devices 116, 118, 140 of the gaming device 100 are configured to display any suitable visual representation or exhibition of the movement of objects; dynamic lighting; video images; images of people, characters, places, things, and faces of cards; and the like. In certain embodiments, the display devices 116, 118, 140 of the gaming device 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The gaming device 100 also includes various features that enable a user to deposit credits in the gaming device 100 and withdraw credits from the gaming device 100, such as in the form of a payout of winnings, credits, etc. For example, the gaming device 100 may include a bill/ticket dispenser 139, a bill/ticket acceptor 128, and a coin acceptor 126 that allows the user to deposit coins into the gaming device 100.

As illustrated in FIG. 2A, the gaming device 100 may also include a currency dispenser 137 that may include a note dispenser configured to dispense paper currency and/or a coin generator configured to dispense coins or tokens in a coin payout tray.

The gaming device 100 may further include one or more speakers 150 controlled by one or more sound cards 28 (FIG. 2B). The gaming device 100 illustrated in FIG. 2A includes a pair of speakers 150. In other embodiments, additional speakers, such as surround sound speakers, may be provided within or on the housing 105. Moreover, the gaming device 100 may include built-in seating with integrated headrest speakers.

In various embodiments, the gaming device 100 may generate dynamic sounds coupled with attractive multimedia images displayed on one or more of the display devices 116, 118, 140 to provide an audio-visual representation or to otherwise display full-motion video with sound to attract users to the gaming device 100 and/or to engage the user during gameplay. In certain embodiments, the gaming device 100 may display a sequence of audio and/or visual attraction messages during idle periods to attract potential users to the gaming device 100. The videos may be customized to provide any appropriate information.

The gaming device 100 may further include a card reader 141 that is configured to read magnetic stripe cards, such as player loyalty/tracking cards, chip cards, and the like. In some embodiments, a user may insert an identification card into a card reader of the gaming device. In some embodiments, the identification card is a smart card having a programmed microchip or a magnetic strip coded with a user's identification, credit totals (or related data) and other relevant information. In other embodiments, a user may carry a portable device, such as a cell phone, a radio frequency identification tag or any other suitable wireless device, which communicates a user's identification, credit totals (or related data) and other relevant information to the gaming device. In some embodiments, money may be transferred to a gaming device through electronic funds transfer. When a user funds the gaming device, the processing circuit determines the amount of funds entered and displays the corresponding amount on the credit or other suitable display as described above.

In some embodiments, the gaming device 100 may include an electronic payout device or module configured to fund an electronically recordable identification card or smart card or a bank or other account via an electronic funds transfer to or from the gaming device 100.

FIG. 2B is a block diagram that illustrates logical and functional relationships between various components of a gaming device 100. It should also be understood that components described in FIG. 2B may also be used in other computing devices, as desired, such as mobile computing devices for example. As shown in FIG. 2B, the gaming device 100 may include a processing circuit 12 that controls operations of the gaming device 100. Although illustrated as a single processing circuit, multiple special purpose and/or general purpose processors and/or processor cores may be provided in the gaming device 100. For example, the gaming device 100 may include one or more of a video processor, a signal processor, a sound processor and/or a communication controller that performs one or more control functions within the gaming device 100. The processing circuit 12 may be variously referred to as a "controller," "microcontroller," "microprocessor" or simply a "computer." The processor may further include one or more application-specific integrated circuits (ASICs).

Various components of the gaming device 100 are illustrated in FIG. 2B as being connected to the processing circuit 12. It will be appreciated that the components may be connected to the processing circuit 12 through a system bus 151, a communication bus and controller, such as a universal serial bus (USB) controller and USB bus, a network interface, or any other suitable type of connection.

The gaming device 100 further includes a memory device 14 that stores one or more functional modules 20. Various functional modules 20 of the gaming device 100 will be described in more detail below in connection with FIG. 2D.

The memory device 14 may store program code and instructions, executable by the processing circuit 12, to control the gaming device 100. The memory device 14 may also store other data such as image data, event data, player input data, random or pseudo-random number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The gaming device 100 may further include a data storage 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The gaming device 100 may include a communication adapter 26 that enables the gaming device 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or NFC that enable the gaming device 100 to communicate, for example, with a mobile communication device operated by a user.

The gaming device 100 may include one or more internal or external communication ports that enable the processing circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processing circuit through a USB hub (not shown) connected to the processing circuit 12.

In some embodiments, the gaming device 100 may include a sensor, such as a camera 127, in communication with the processing circuit 12 (and possibly controlled by the processing circuit 12) that is selectively positioned to acquire an image of a user actively using the gaming device 100 and/or the surrounding area of the gaming device 100. In one embodiment, the camera 127 may be configured to selectively acquire still or moving (e.g., video) images and may be configured to acquire the images in either an analog, digital or other suitable format. The display devices 116, 118, 140 may be configured to display the image acquired by the camera 127 as well as display the visible manifestation of the game in split screen or picture-in-picture fashion. For example, the camera 127 may acquire an image of the user and the processing circuit 12 may incorporate that image into the primary and/or secondary game as a game image, symbol or indicia.

Various functional modules of that may be stored in a memory device 14 of a gaming device 100 are illustrated in FIG. 2C. Referring to FIG. 2C, the gaming device 100 may include in the memory device 14 a game module 20A that includes program instructions and/or data for operating a hybrid wagering game as described herein. The gaming device 100 may further include a player tracking module 20B, an electronic funds transfer module 20C, an input device interface 20D, an audit/reporting module 20E, a communication module 20F, an operating system kernel 20G and a random number generator 20H. The player tracking module 20B keeps track of the play of a user. The electronic funds transfer module 20C communicates with a back end server or financial institution to transfer funds to and from an account associated with the user. The input device interface 20D interacts with input devices, such as the input device 130, as described in more detail below. The communication module 20F enables the gaming device 100 to communicate with remote servers and other gaming devices using various secure communication interfaces. The operating system kernel 20G controls the overall operation of the gaming device 100, including the loading and operation of other modules. The random number generator 20H generates random or pseudorandom numbers for use in the operation of the hybrid games described herein.

In some embodiments, a gaming device 100 comprises a personal device, such as a desktop computer, a laptop computer, a mobile device, a tablet computer or computing device, a personal digital assistant (PDA), or other portable computing devices. In some embodiments, the gaming device 100 may be operable over a wireless network, such as part of a wireless gaming system. In such embodiments, the gaming machine may be a hand-held device, a mobile device or any other suitable wireless device that enables a user to play any suitable game at a variety of different locations. It should be appreciated that a gaming device or gaming machine as disclosed herein may be a device that has obtained approval from a regulatory gaming commission or a device that has not obtained approval from a regulatory gaming commission.

Figure 2D:
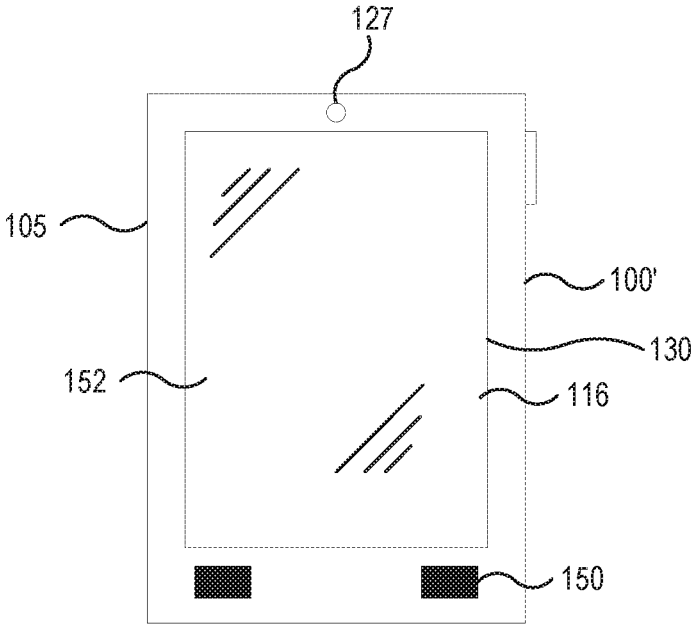
FIG. 2D is perspective view of a gaming device that can be configured according to some embodiments.

For example, referring to FIG. 2D, a gaming device 100' may be implemented as a handheld device including a compact housing 105 on which is mounted a touchscreen display device 116 including a digitizer 152. As described in greater detail with respect to FIG. 3 below, one or more input devices 130 may be included for providing functionality of for embodiments described herein. A camera 127 may be provided in a front face of the housing 105. The housing 105 may include one or more speakers 150. In the gaming device 100', various input buttons described above, such as the cashout button, gameplay activation button, etc., may be implemented as soft buttons on the touchscreen display device 116 and/or input device 130. In this embodiment, the input device 130 is integrated into the touchscreen display device 116, but it should be understood that the input device may also, or alternatively, be separate from the display device 116. Moreover, the gaming device 100' may omit certain features, such as a bill acceptor, a ticket generator, a coin acceptor or dispenser, a card reader, secondary displays, a bet display, a credit display, etc. Credits can be deposited in or transferred from the gaming device 100' electronically.

Figure 2E:
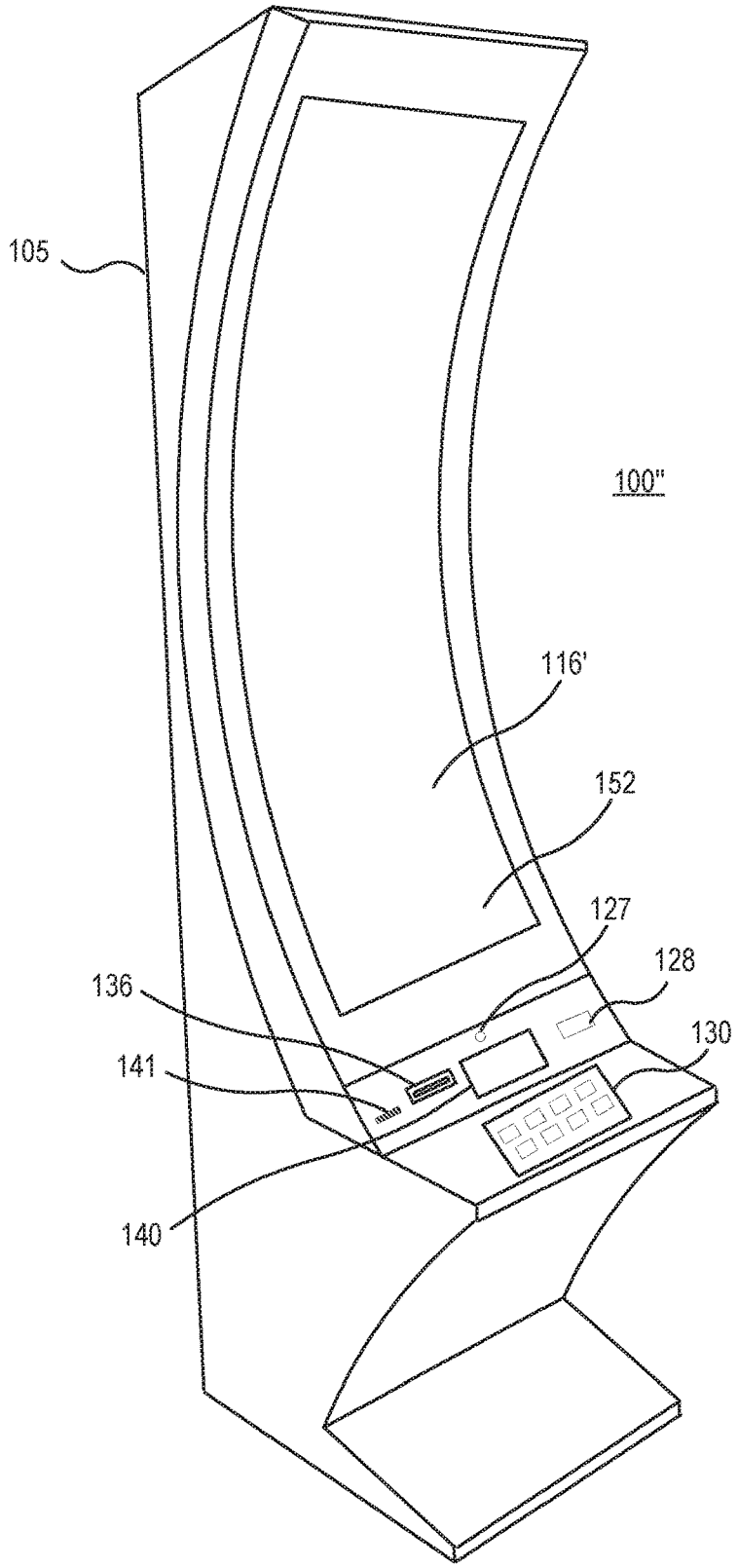
FIG. 2E is a perspective view of a gaming device according to further embodiments.

FIG. 2E illustrates a standalone gaming device 100" having a different form factor from the gaming device 100 illustrated in FIG. 2A. In particular, the gaming device 100" is characterized by having a large, high aspect ratio, curved primary display device 116' provided in the housing 105, with no secondary display device. The primary display device 116' may include a digitizer 152 to allow touchscreen interaction with the primary display device 116'. The gaming device 100" may further include a player tracking display 142, an input device 130, a bill/ticket acceptor 128, a card reader 138, and a bill/ticket dispenser 136. The gaming device 100" may further include one or more cameras 127 to enable facial recognition and/or motion tracking.

Although illustrated as certain gaming devices, such as electronic gaming machines (EGMs) and mobile devices, similar functions and/or operations as described herein may include wagering stations that may include electronic game tables, conventional game tables including those involving cards, dice and/or roulette, and/or other wagering stations such as sports book stations, video poker games, skill-based games, virtual casino-style table games, or other casino or non-casino style games. Further, gaming devices according to embodiments herein may be implemented using other computing devices and mobile devices, such as smart phones, tablets, and/or personal computers, among others.

Input Device Features

Figure 3:
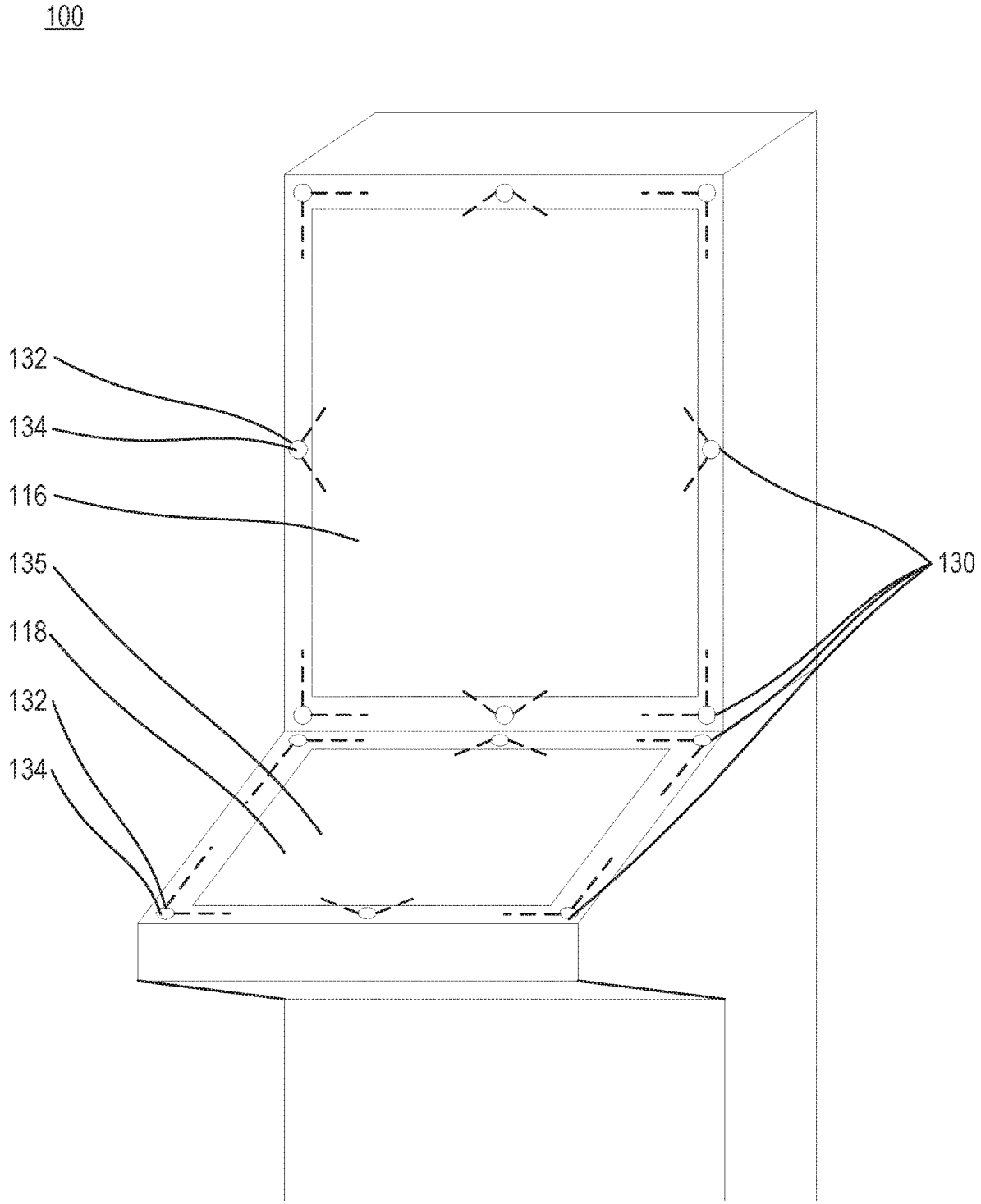
FIG. 3 is a diagram of a gaming device having gesture input devices to detect user gestures associated with the gaming device, according to an embodiment.

Referring now to FIG. 3, a gaming device 100 having a plurality of input devices 130 is illustrated according to an embodiment. In this embodiment, the input devices include gesture input devices 132 including a plurality of gesture sensors 134 to detect user gestures associated with the gaming device 100. The gesture sensors 134 are arranged around the primary display device 116 and the secondary display device 118 in order to detect gestures associated with user interface elements of the display devices 116, 118. For example, each gesture sensor 134 may provide a gesture input value corresponding to the gesture performed by the user. The gesture sensors 134 may include ultrasonic sensors, optical (e.g., infrared) sensors, image capture devices, and/or other suitable sensors for detecting gestures associated with the gaming device 100. In some embodiments, the gesture input sensors may include three dimensional (3D) gesture input sensors to detect a 3D gesture performed by the user, with each 3D gesture input sensor providing a 3D gesture input value corresponding to the 3D gesture performed by the user. In this example, the primary display device 116 and/or secondary display device 118 may also include touchscreen input device 135 for detecting touch input at the display devices 116, 118.

Figure 4B:
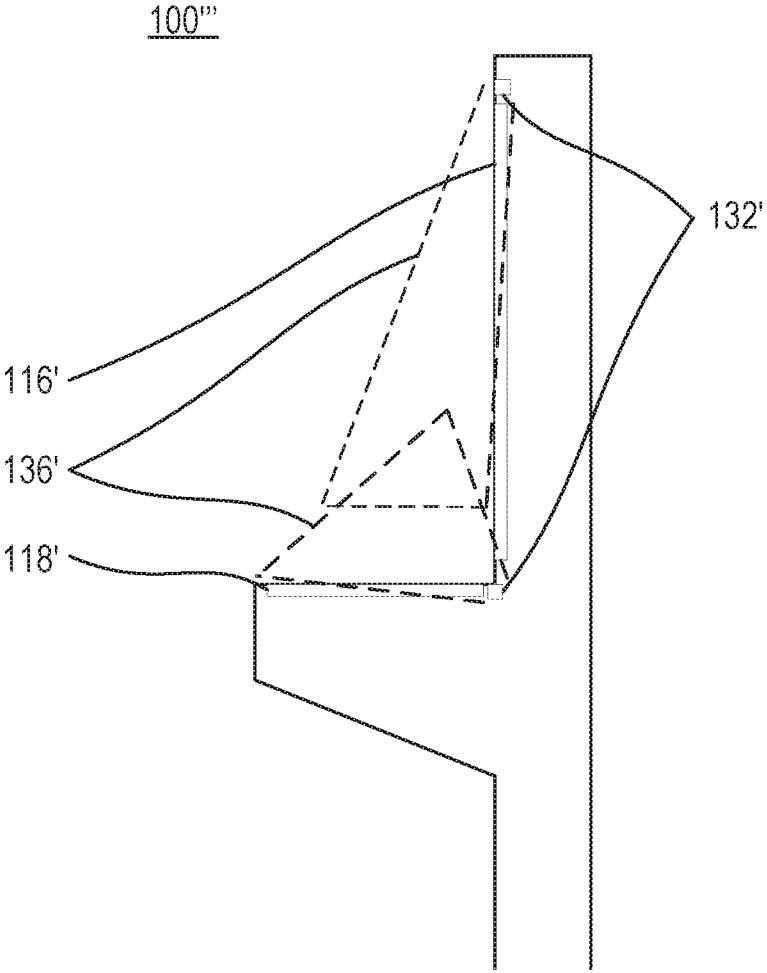
FIGS. 4A and 4B are diagrams of alternative gesture input device configurations for gaming devices, according to some embodiments.
Figure 4A:
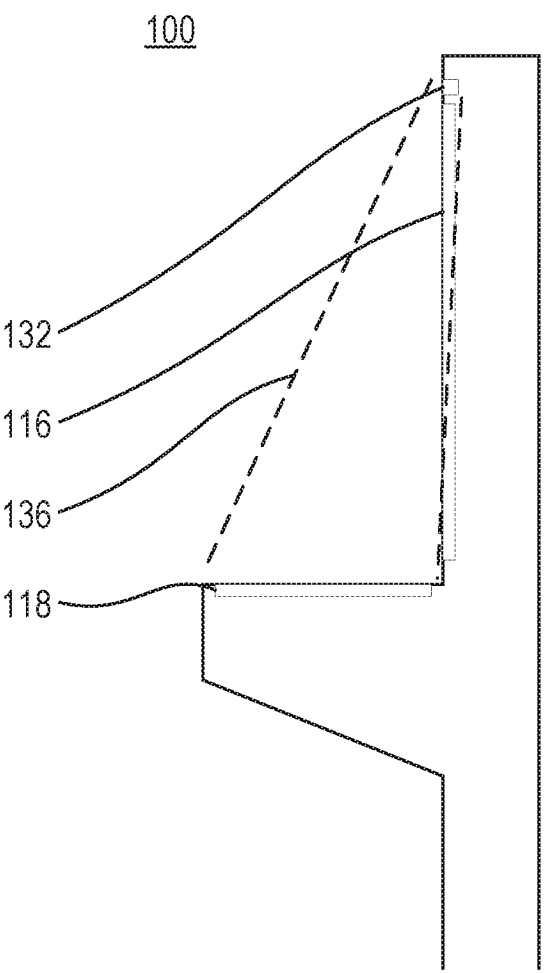

FIGS. 4A and 4B are diagrams of alternative gesture input device configurations for gaming devices, according to some embodiments. In the example of FIG. 4A, a gaming device 100 includes a primary display device 116 and a secondary display device 118, with a gesture input device 132 positioned above the primary display device 116 to capture gesture input in a gesture input region 136 proximate the primary display device 116 and secondary display device 118. Alternatively, as shown in FIG. 4B, a gaming device 100" may include a plurality of gesture input device 132' positioned above and below the primary display device 116' to capture gesture input in a plurality of overlapping gesture input regions 136' proximate the primary display device 116' and secondary display device 118'. By capturing gesture inputs from a plurality of different directions and in different gesture input regions 136', the different inputs can be compared and synchronized with each other to improve the overall accuracy and precision for the gesture inputs.

Other Gaming Device Features

Embodiments described herein may be implemented in various configurations for gaming devices 100, including but not limited to: (1) a dedicated gaming device, wherein the computerized instructions for controlling any games (which are provided by the gaming device) are provided with the gaming device prior to delivery to a gaming establishment; and (2) a changeable gaming device, where the computerized instructions for controlling any games (which are provided by the gaming device) are downloadable to the gaming device through a data network when the gaming device is in a gaming establishment. In some embodiments, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a user. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a user.

In some embodiments, a gaming device may be operated by a mobile device, such as a mobile telephone, tablet other mobile computing device. For example, a mobile device may be communicatively coupled to a gaming device and may include a user interface that receives user inputs that are received to control the gaming device. The user inputs may be received by the gaming device via the mobile device.

In some embodiments, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more gaming devices; and/or (c) one or more personal gaming devices, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the gaming device are executed by the central server, central controller, or remote host. In such "thin client" embodiments, the central server, central controller, or remote host remotely controls any games (or other suitable interfaces)

displayed by the gaming device, and the gaming device is utilized to display such games (or suitable interfaces) and to receive one or more inputs or commands. In other such embodiments, computerized instructions for controlling any games displayed by the gaming device are communicated from the central server, central controller, or remote host to the gaming device and are stored in at least one memory device of the gaming device. In such "thick client" embodiments, the at least one processor of the gaming device executes the computerized instructions to control any games (or other suitable interfaces) displayed by the gaming device.

In some embodiments in which the gaming system includes: (a) a gaming device configured to communicate with a central server, central controller, or remote host through a data network; and/or (b) a plurality of gaming devices configured to communicate with one another through a data network, the data network is an internet or an intranet. In certain such embodiments, an internet browser of the gaming device is usable to access an internet game page from any location where an internet connection is available. In one such embodiment, after the internet game page is accessed, the central server, central controller, or remote host identifies a user prior to enabling that user to place any wagers on any plays of any wagering games. In one example, the central server, central controller, or remote host identifies the user by requiring a player account of the user to be logged into via an input of a unique username and password combination assigned to the user. It should be appreciated, however, that the central server, central controller, or remote host may identify the user in any other suitable manner, such as by validating a player tracking identification number associated with the user; by reading a player tracking card or other smart card inserted into a card reader (as described below); by validating a unique player identification number associated with the user by the central server, central controller, or remote host; or by identifying the gaming device, such as by identifying the MAC address or the IP address of the internet facilitator. In various embodiments, once the central server, central controller, or remote host identifies the user, the central server, central controller, or remote host enables placement of one or more wagers on one or more plays of one or more primary or base games and/or one or more secondary or bonus games, and displays those plays via the internet browser of the gaming device.

It should be appreciated that the central server, central controller, or remote host and the gaming device are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for users to use a variety of gaming devices to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with users.

Figure 5:
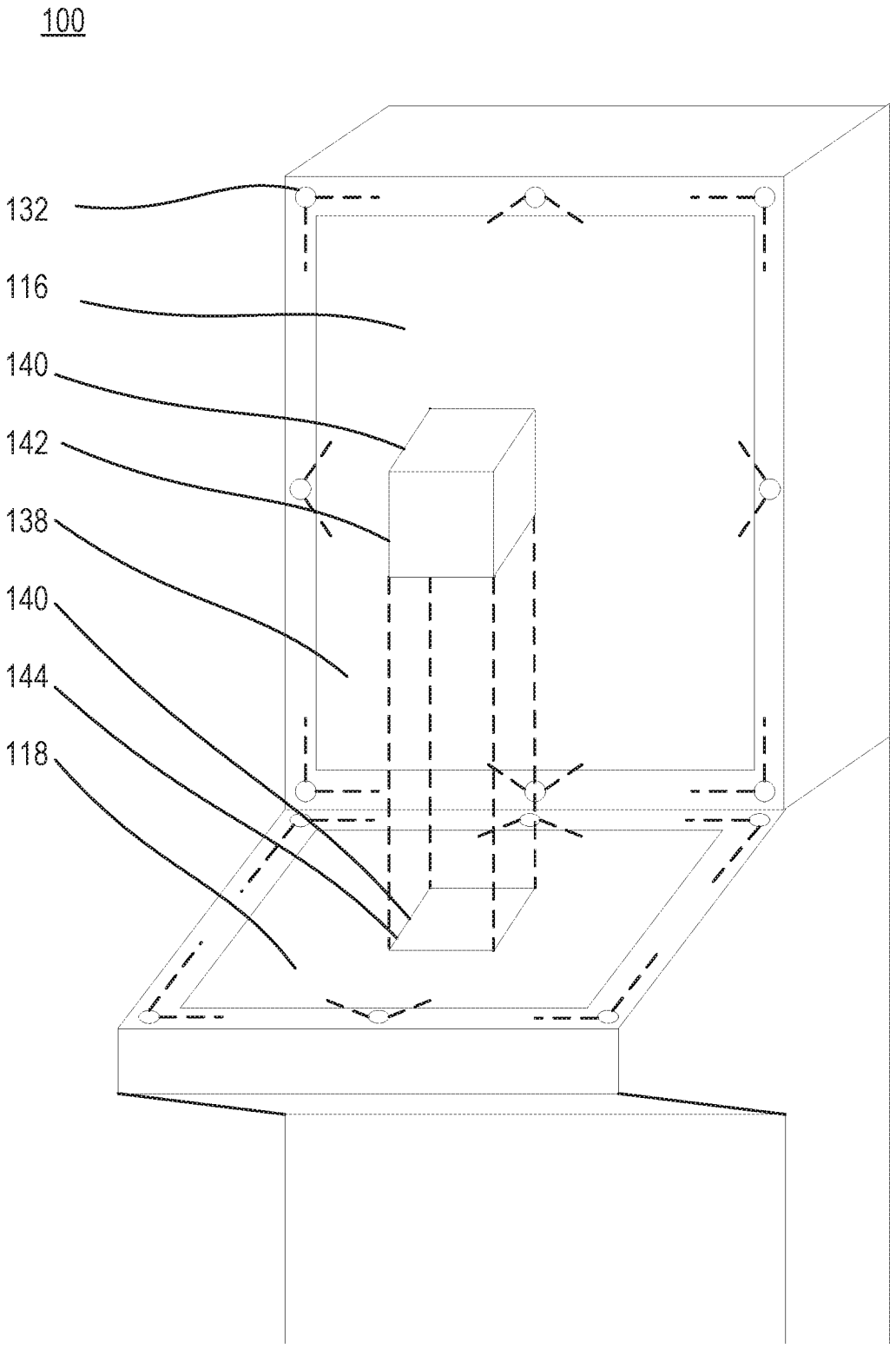
FIG. 5 is a diagram of a gaming device employing gesture inputs for controlling three-dimensional (3D) graphical interface elements on a 3D display of a gaming device and simultaneously controlling two-dimensional (2D) graphical interface elements on a 2D display of the gaming device, according to an embodiment.

FIG. 5 is a diagram of a gaming device 100 employing gesture inputs. In this example, the gaming device includes a primary 3D display device 116 and a secondary 2D display device 118, which provide a user interface 138 having a plurality of user interface elements 168. A plurality of gesture input devices 132 provide gesture input values for controlling and modifying various user interface elements 168, including a 3D graphical interface element 170 being displayed by the primary 3D display device 116 and a 2D graphical interface element 172 being displayed by the secondary 2D display device 118. In this example, the 2D graphical interface element 172 is a 2D representation of the 3D graphical interface element 170, where controlling, moving, and/or otherwise modifying the 3D graphical interface element 170 causes the 2D graphical interface element to be simultaneously controlled, moved, or otherwise modified.

Figure 6:
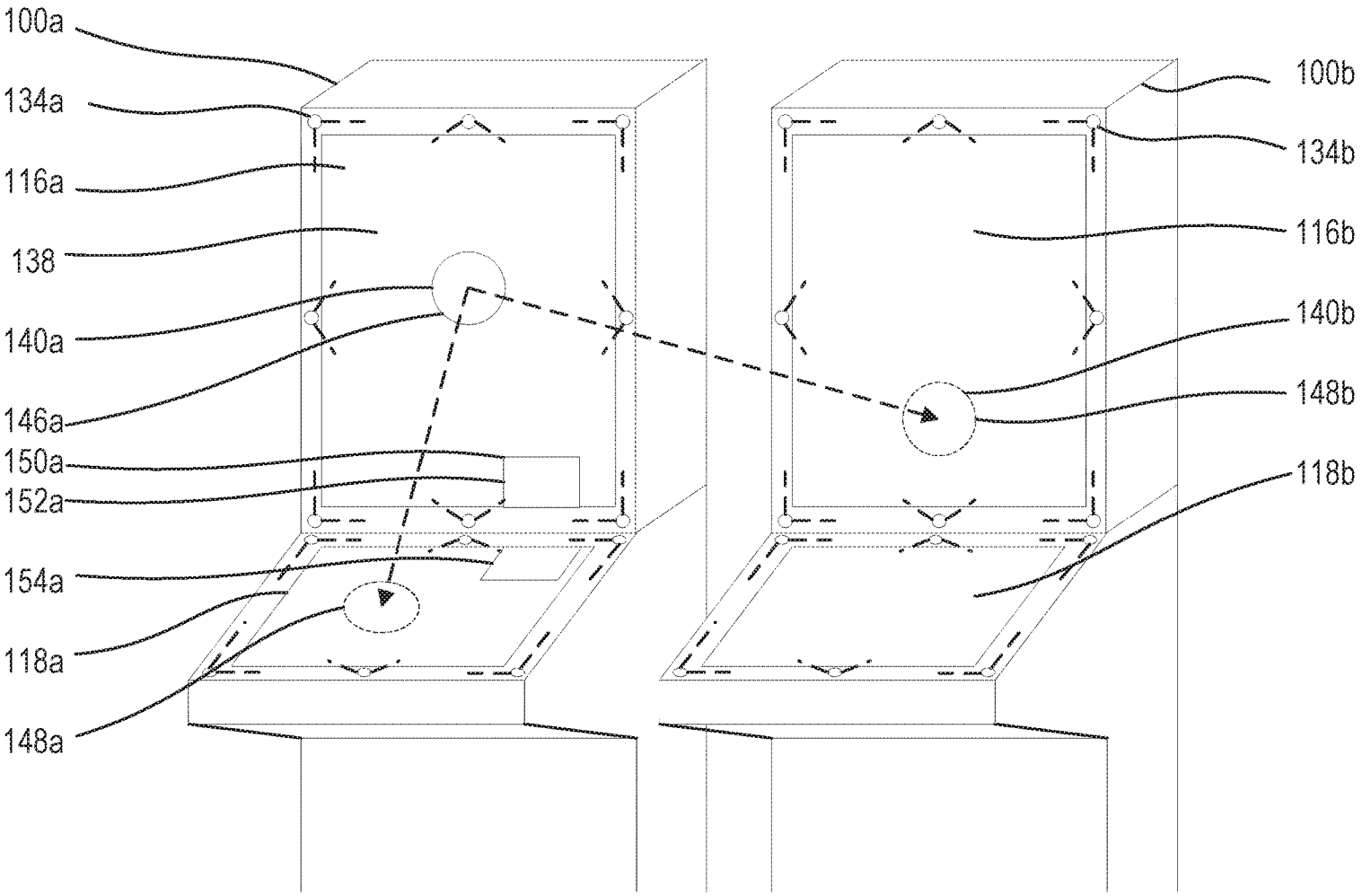
FIG. 6 is a diagram of gaming devices employing gesture inputs for controlling graphical interface elements on multiple displays of the gaming devices, according to an embodiment.

In some embodiments, the various graphical interface elements may be moved between different display devices, including between display devices on different gaming devices. In this regard, FIG. 6 is a diagram of gaming devices 100 employing gesture inputs for controlling user interface elements 168 on multiple displays of the gaming devices 100, according to an embodiment. In this example, each gaming device 100 includes a primary display device 116, a secondary display device 118, and a plurality of gesture input sensors 134 for detecting gesture inputs. In response to receiving gesture input from a user at one or both gaming devices 100, a first graphical interface element **146*a* on the primary display device 116*a* of a first gaming device 100*a* may be controlled, moved, or otherwise modified so that a second graphical interface element 148*a* is displayed on the secondary display device 118*a* of the gaming device 100*a*, or so that a second graphical interface element 148*b* is displayed on one of the display devices 116*a*, 118*b* of another gaming device 100*b*. The second graphical interface element 148 may correspond to the first graphical interface element 146 moved within the user interface 138, or may be further modified as part of the movement within the user interface 138**, as desired.

As part of controlling, moving, or otherwise modifying the user interface elements 168, portions of a graphical user interface element may be displayed on different display devices simultaneously. For example, FIG. 6 further illustrates another graphical interface element **150*a* being moved between the primary display device 116*a* and the secondary display device 118*a* of the gaming device 100*a*. As the graphical interface element 150*a* is being moved, a first portion 152*a* of the graphical interface element 150*a* is displayed on the primary display device 116*a* and a second portion 154*a* of the graphical interface element 150*a* is displayed on the secondary display device 118*a***.

In some embodiments, graphical interface elements may also be moved between display devices of one or more gaming devices and a shared display device that is shared by more than one gaming device. In this regard, FIG. 7 is a diagram of a group of gaming devices 100 employing gesture inputs for controlling graphical interface elements 170 on multiple display devices 116, 118 of different gaming devices 100 and on a shared display device 156, according to an embodiment.

Figure 7:
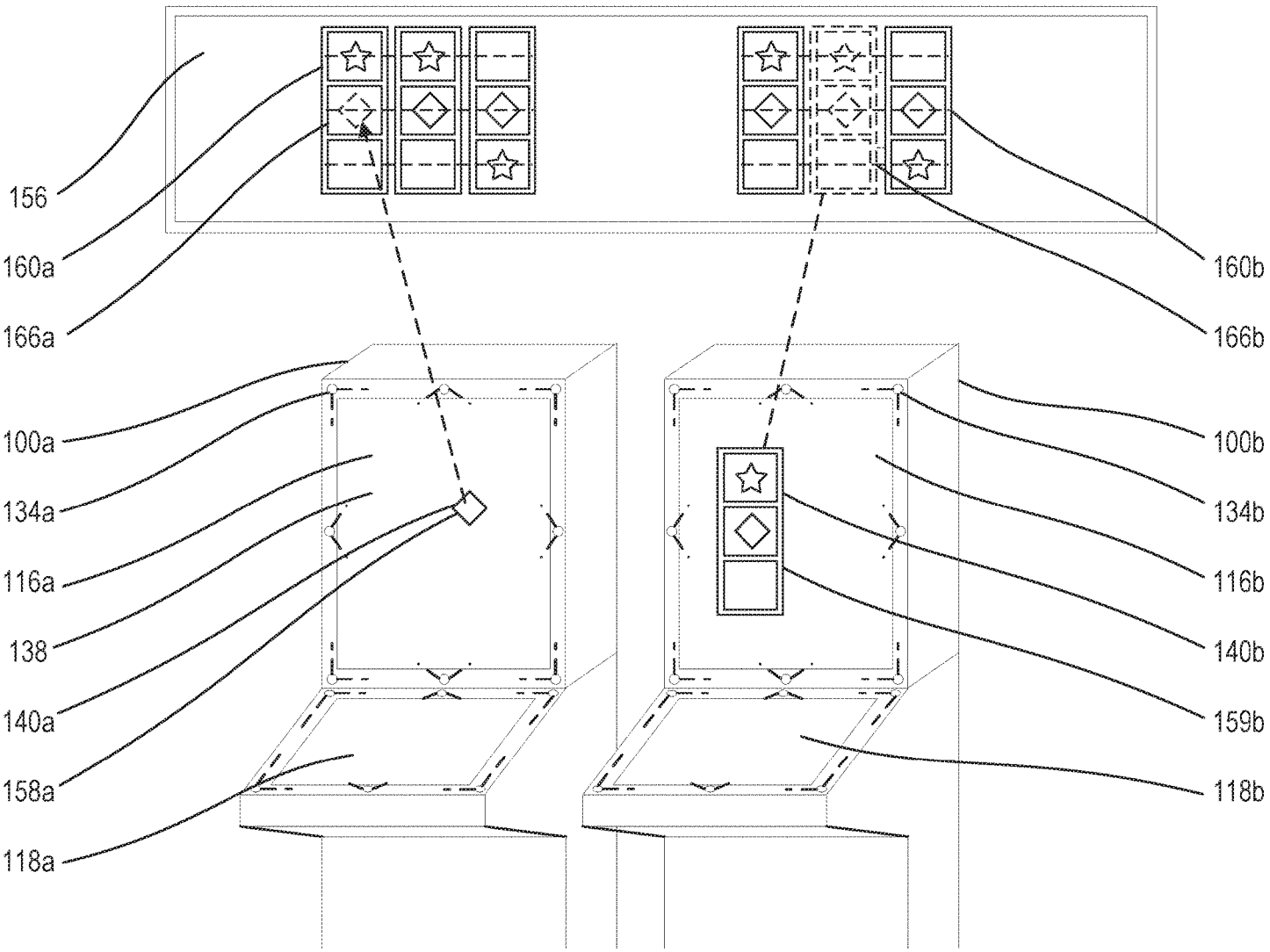
FIG. 7 is a diagram of a group of gaming devices employing gesture inputs for controlling graphical interface elements on multiple displays of multiple gaming devices and on a shared display device, according to an embodiment.

In the embodiment of FIG. 7, a pair of gaming devices 100 is illustrated, with each gaming device 100 including a primary display device 116 and a secondary display device 118 that are controlled in part by a plurality of gesture input devices 132. In some embodiments, each gaming device 100 may be controlled by gesture input from a different respective user, e.g., with display devices 116*a*, 118*a* of the first gaming device 100*a* modifying graphical interface elements 170*a* based on receiving gesture input values from gesture input devices 132*a*, and with display devices 116*b*, 118*b* of the second gaming device 100*b* modifying graphical interface elements 170*b* based on receiving gesture input values from gesture input devices 132*b*. The gesture input values received by the gaming devices 100*a*, 100*b* may also initiate a shared game, between the gaming devices 100*a*, 100*b*. For example, the shared game may be a competitive game, in which an award is based on a user defeating the other, or a cooperate game, in which users play together to collectively qualify for a game award.

In the example of FIG. 7, one gaming device 100*a* interacts with the shared display device 156 to position a game symbol 158*a*, e.g., for a slot game, in a game play position 166*a* of a wagering game interface 160*a*, e.g., an array of graphical slot reels, being displayed on the shared display device 156. Another gaming device 100*b* interacts with the shared display device 156 to position a graphical slot reel 159*b* having a plurality of game symbols 158*b* in a game play position 166*b* of a wagering game interface 160*b*, e.g., an array of graphical slot reels, being displayed on the shared display device 156.

Figure 8:
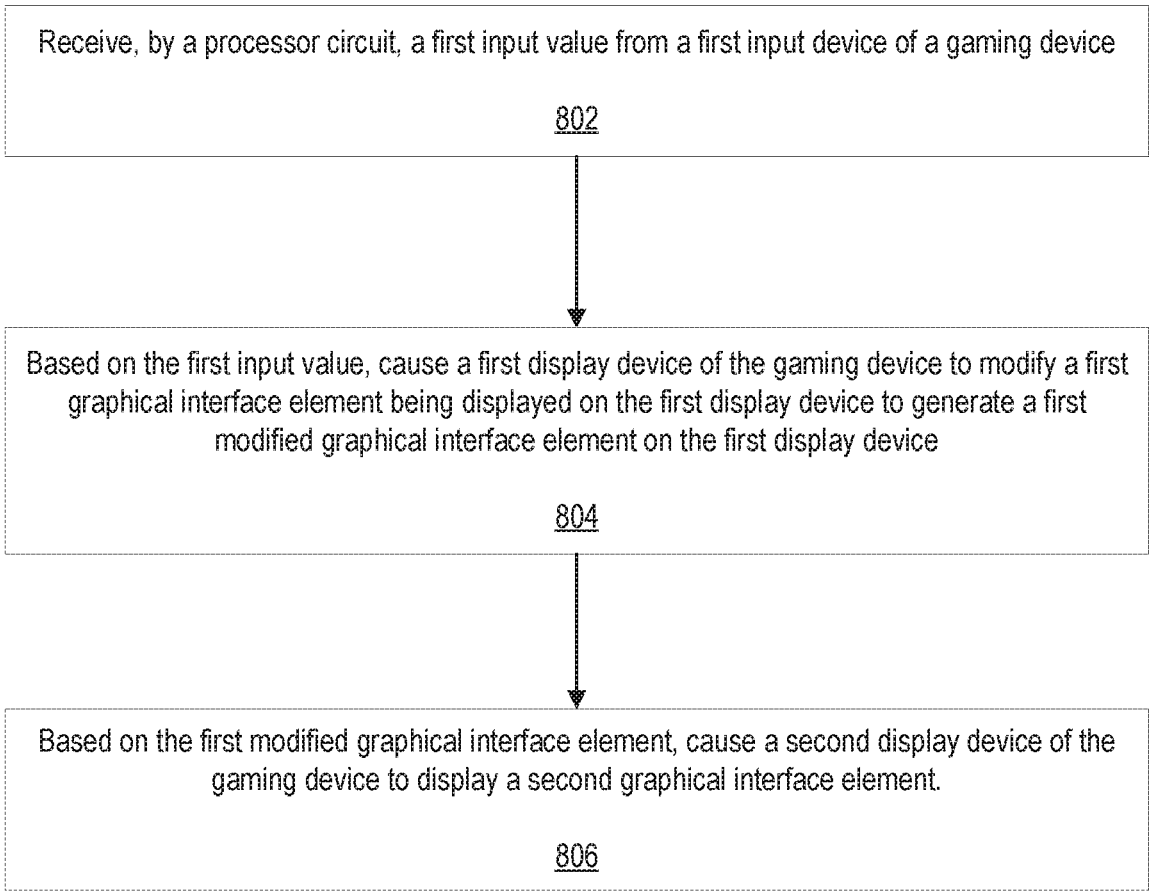
FIG. 8 is a flowchart illustrating operations of systems/methods according to some embodiments.

Referring now to FIG. 8, a flowchart of operations 800 of systems/methods is illustrated, according to some embodiments. The operations 800 may include receiving, by a processor circuit, a first input value from a first input device of a gaming device (Block 802). The operations 800 may further include, based on the first input value, cause a first display device of the gaming device to modify a first graphical interface element being displayed on the first display device to generate a first modified graphical interface element on the first display device (Block 804). The operations 800 may further include, based on the first modified graphical interface element, cause a second display device of the gaming device to display a second graphical interface element (Block 806).

Further Definitions and Embodiments

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processing circuit of a general purpose computer, special purpose computer, or other programmable data processing apparatus to produce a machine, such that the instructions, which execute via the processing circuit of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming system comprising:

a first gaming device comprising:

a first display device, the first display device comprising a three-dimensional (3D) display device;

a second display device, the second display device comprising a two-dimensional (2D) display device; and a first 3D input device;

a processor circuit; and a memory coupled to the processor circuit, the memory comprising machine-readable instructions that, when executed by the processor circuit, cause the processor circuit to:

receive a first 3D input value from the first 3D input device;

based on the first 3D input value, cause the first display device to move a first 3D graphical interface element of a wagering game being displayed on the first display device from a first 3D location of the first display device to a second 3D location of the first display device; and based on movement of the first 3D graphical interface element from the first 3D location to the second 3D location, cause the second display device to simultaneously move a second 2D graphical interface element of the wagering game corresponding to the first modified 3D graphical interface element from a first 2D location of the second display device corresponding to the first 3D location to a second 2D location of the second display device corresponding to the second 3D location; and a second gaming device comprising a third display device, a fourth display device and a second 3D input device, wherein the instructions further cause the processor circuit to:

receive a second 3D input value from the first 3D input device;

based on the second 3D input value, move the first 3D graphical interface element from the first display device to a third 3D location of the third display device;

based on the movement of the first 3D graphical interface element, move the first 2D graphical interface element from the second display device to a third 2D location of the fourth display device, wherein movement of the first 3D graphical interface element to the third display device further comprises removal of the first 3D graphical interface element from the first display device, and wherein movement of the first 2D graphical interface element to the fourth display device further comprises removal of the first 2D graphical interface element from the second display device.

2. The system of claim 1, wherein the 2D graphical interface element comprises a 2D representation of the 3D graphical interface element.

3. The system of claim 1, wherein the instructions further cause the processor circuit to:

based on the first 3D input value and the second 3D input value, initiate a competitive wagering game between the first gaming device and the second gaming device.

4. The system of claim 1, wherein the instructions further cause the processor circuit to:

based on the first 3D input value and the second 3D input value, initiate a cooperative wagering game between the first gaming device and the second gaming device.

5. The system of claim 1, wherein the first 3D input device comprises a 3D gesture input sensor to detect a 3D gesture performed by a user associated with the first display device, and wherein the first 3D input value from the first input device comprises a first 3D gesture input value corresponding to the 3D gesture performed by the user.

6. The system of claim 5, wherein the 3D gesture input sensor comprises a plurality of gesture input sensors to detect the 3D gesture performed by the user.

7. The system of claim 1, wherein the instructions further cause the processor circuit to:

receive a second input value from the first input device;

based on the second input value, cause the first display device to further move the first 3D graphical interface element of the wagering game to a third 3D location of the first display device; and cause the second display device to simultaneously move the second 2D graphical interface element of the wagering game to a third 2D location of the second display device corresponding to the third 3D location.

8. A system comprising:

a first gaming device comprising:

a first display device; and a first gesture input device comprising a gesture input sensor to detect a gesture performed by a first user associated with the first display device;

a second gaming device comprising:

a second display device; and a second gesture input device comprising a gesture input sensor to detect a gesture performed by a second user associated with the second display device;

a third display device separate from the first gaming device and the second gaming device, the third display device comprising a shared display;

a processor circuit; and a memory coupled to the processor circuit, the memory comprising machine-readable instructions that, when executed by the processor circuit, cause the processor circuit to:

receive a first gesture input value corresponding to the gesture performed by the first user from the first gesture input device;

based on the first input value, cause the first display device to modify a first graphical interface element being displayed on the first display device to generate a first modified graphical interface element on the first display device;

based on the first modified graphical interface element, cause the shared display of the third display device to display a shared graphical interface element;

receive a second gesture input value corresponding to the gesture performed by the second user from the second gesture input device;

based on the second input value, cause the second display device to modify a second graphical interface element being displayed on the second display device to generate a second modified graphical interface element on the second display device; and based on the second modified graphical interface element, cause the shared display of the third display device to modify the shared graphical interface element being displayed on the shared display device to generate a shared modified graphical interface element on the shared display of the third display device, wherein the instructions further cause the processor circuit to:

move the first modified graphical interface element from the first display device to the third display device, wherein moving the first modified graphical interface element comprises:

display of the first modified graphical interface element on the third display device; and removal of the first modified graphical interface element from the first display device; and remove the first modified graphical interface element from the third display device based on the second modified graphical interface element.

9. The system of claim 8, wherein the instructions further cause the processor circuit to:

based on removal of the first modified graphical interface element from the third display device, display the first modified graphical interface element on the second display device.

10. A method comprising:

receiving, by a processor circuit, a first input value from a first input device of a first gaming device;

based on the first input value, causing a first display device of the first gaming device to modify a first graphical interface element being displayed on the first display device to generate a first modified graphical interface element on the first display device; and based on the first modified graphical interface element, causing a shared display device of a third display device to display a shared graphical interface element;

receiving, by the processor circuit, a second input value from a second input device of a second gaming device;

based on the second input value, causing a second display device of the second gaming device to modify a second graphical interface element being displayed on the second display device to generate a second modified graphical interface element on the second display device; and based on the second modified graphical interface element, causing the shared display device to stop displaying the shared graphical interface element on the shared display device, wherein the third display device is separate from the first gaming device and the second gaming device.

* * * * *